United States Patent [19]

Hasler et al.

[11] 4,432,770

[45] Feb. 21, 1984

[54] RAPID DYEING OF POLYESTER FIBERS WITH A MIXTURE OF DISPERSE DYES

[75] Inventors: Rolf Hasler, Oberwil; Beat Henzi, Basel; Ernst Schnider, Füllinsdorf; Hermann Ulshoefer, Ettingen, all of Switzerland

[73] Assignee: Sandoz Ltd., Basel, Switzerland

[21] Appl. No.: 442,366

[22] Filed: Nov. 17, 1982

[30] Foreign Application Priority Data

Nov. 21, 1981 [DE] Fed. Rep. of Germany ..... 3146178

[51] Int. Cl.[3] ..... C09B 67/22; D06P 3/54

[52] U.S. Cl. ..... 8/638; 8/400; 8/475; 8/639; 8/922

[58] Field of Search ..... 8/638, 639, 475, 400

[56] References Cited

U.S. PATENT DOCUMENTS

| | | | |
|---|---|---|---|
| 4,125,371 | 11/1978 | Beutler | 8/400 |
| 4,185,959 | 1/1980 | Imada et al. | 8/639 |
| 4,255,154 | 3/1981 | Zurbuchen et al. | 8/638 |
| 4,351,641 | 9/1982 | Tymon | 8/638 |

FOREIGN PATENT DOCUMENTS

| | | |
|---|---|---|
| 1575399 | 9/1980 | United Kingdom . |
| 1596179 | 8/1981 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

Disclosed is a method of rapid dyeing a substrate comprising polyester fibres at a temperature above 100° C. comprising bringing into contact with the substrate an aqueous dyebath containing a mixture of at least two disperse dyes having each individually specific physicochemical properties.

20 Claims, No Drawings

RAPID DYEING OF POLYESTER FIBERS WITH A MIXTURE OF DISPERSE DYES

The present invention relates to a method for rapid dyeing polyester fibres with a mixture of disperse dyes.

It is highly desirable to shorten dyeing processes, particularly HT-dyeing processes in order to reduce energy costs. This is particularly important when polyester is dyed at a high temperature, e.g. at 120°-130° C.; usually the HT-dyeing of polyester is carried out for 40 to 90 minutes. Attempts have been made to shorten the dyeing time for polyester, i.e. to obtain a significant exhaustion of the dyebath at an earlier stage of the dyeing process. However, this "rapid" dyeing must be achieved without impairing the reproducibility and the fastness properties of the dyeings.

Surprisingly, it has been found that polyester fibres can be rapid dyed at a high temperature, i.e. at a temperature above 100° C., with a mixture of disperse dyes having each specific physicochemical properties.

Accordingly, the present invention provides a method of rapid dyeing a substrate comprising polyester fibres at a temperature above 100° C. comprising bringing into contact with the substrate an aqueous dyebath containing a mixture of at least two disperse dyes having each individually (i) a degree of adsorption A≧90% after 5 minutes at 130° C. and ≧95% after 20 minutes at 130° C. for a standard dyeing depth of 4×1/1, the starting dyeing temperature being 70° C. and the heating rate 3° C./minute, (ii) a diffusion coefficient D at 130° C.≧$1.6.10^{-10}$ $cm^2.sec^{-1}$ (iii) a ratio C.°/RTT≧14 wherein C.° is the saturation concentration in mg dye per g substrate and RTT is the dye concentration in mg per g substrate required for the standard dyeing depth 1/1, and (iv) a kinetic parameter Z≧$1.6.10^{-4}$ wherein $Z=k.C.°/RTT\sqrt{D}$ wherein $k=1\ cm^{-1}\ sec^{\frac{1}{2}}$.

Preferably the disperse dyes which are used for the process of the invention have a degree of adsorption A at different dyeing temperature for various treatment times as indicated in the Table below. Texturized polyester samples (Dacron® T 56, Du Pont) are dyed ech in a closed dyeing machine with an aqueous dyebath at a goods to liquor ratio of 1:10 to a standard dyeing depth of 4×1/1. One sample is introduced at 70° C. into each of a series of dyebaths having the same composition and the dyebaths are heated at a rate of 3° C./minute to the indicated temperature and maintained at that temperature for the time shown in the Table. The samples are taken out of the dyebaths, reductively aftercleared at 75° C. for 20 minutes with a bath containing 4 ml/l NaOH 36° Be, 2 g/l sodium hydrosulphite and optionally 0.5 ml/ of a commercially available dispersing agent based on an ethoxylated aliphatic alcohol. The amount of fixed disperse dye for each sample is indicated in the following Table. It can be measured spectrophotometrically, e.g. from the solution obtained after refluxing at the boil the dyed sample for e.g. 2 times 15 minutes in a fresh organic solvent, e.g. dimethylformamide.

TABLE

| Temperature °C. | Maintainance time in minutes | A in % |
|---|---|---|
| 120° | 10 | ≧70 |

TABLE-continued

| Temperature °C. | Maintainance time in minutes | A in % |
|---|---|---|
| 125° | 5 | ≧80 |
| 130° | 5 | ≧90 |
| 130° | 20 | ≧95 |

The diffusion coefficient D is assessed according to the method described by Mamdouh Hammoudeh et al in Melliand 52 (1971), 1063-1068; a polyester film is rolled up on a glass rod and dyed for 2 hours at 130° C. as disclosed in this article. Preferably the disperse dyes used according to the invention have a diffusion coefficient D≧$1.8.10^{-10}$ $cm^2\ sec^{-1}$.

The ratio C.°/RTT is dimensionless. C.° corresponds to the indefinite concentration $C_\infty$ obtained by extrapolation from the diffusion curve (concentration of diffused dye plotted with the polyester film layers). Preferably the ratio C.°/RTT is ≧16.

The kinetic value Z is a parameter which is defined according to the kinetic study described by J. Cegerra et al in Textile Research Journal, May 1967, 348. Z is preferably ≧$1.8.10^{-4}$, more preferably ≧$2.0.10^{-4}$.

The disperse dyes which are mixed according to the process of the invention belong to a variety of different classes of disperse dyes. They are for example styryl dyes, anthraquinone dyes and in particular azo dyes, such as monoazo dyes, e.g. pyridone azo dyes.

According to the invention, the disperse dye mixtures suitable for rapid dyeing comprise at least two disperse dyes, i.e. at least two individual disperse dyes. Where the normal technical process for the production of a disperse dye gives rise to a technical mixture e.g. a mixture of isomers or homologues, this mixture is to be taken as an individual component. Preferred combinations of disperse dyes are mixtures of 2 or 3 individual disperse dyes, more preferably the mixtures based on a dichromatic or trichromatic system.

Depending on the desired depth of shade, the amounts in which the disperse dyes are used in the dyebath can vary within wide limits. In general, amounts from 0.001 to 30, preferably 0.01 to 6% by weight of two or more disperse dyes, based on the weight of the polyester substrate, are advantageous.

The dyeing process of the invention may be carried out continuously, e.g. by padding, or by exhaust, preferably the latter. The liquor to goods ratio may vary within the range of 0.2:1 to 100:1, preferably 1:1 to 15:1. The process is generally effected according to the conventional HT (high temperature) conditions, i.e. at a temperature above 100° C., preferably in the range of 120° to 140° C., more preferably 120° to 130° C. The substrate to be dyed may be introduced at a temperature of about 70° to 80° C. into the dyebath and the temperature of the dyebath is raised preferably at a rate of 2° to 3° C./minute. The dyeing temperature is generally kept at 120°-130° C. for 5 to 30 minutes, preferably at 120° for 15 to 30 minutes, at 125° C. for 10 to 20 minutes, more preferably for 10 to 15 minutes, or at 130° C. for 5 to 15 minutes, more preferably for 5 to 10 minutes. The dyed material is then rinsed and dried. No reductive afterclearing step is necessary after the dyeing.

When the dyeing process is carried out by exhaust, it may be performed in a conventional closed and advantageously, pressure-resistant HT-dyeing machine, for example in a jet HT-dyeing machine, a HT-circulating liquor machine or a HT-beam dyeing machine.

In addition to the disperse dyes, the dyebath may contain further ingredients, e.g. acids or salts for providing the adequate pH value, dispersing agents, levelling agents, carriers etc. . . . Preferably anionic dispersing agents are used, for example sulphated aliphatic $C_{6-20}$ alcohols, sulphonated unsaturated fatty acids, fatty acid esters or oils such as castor oil, ethoxylated fatty amines, fatty acids or aliphatic alcohols, alkylsulphonates, alkylarylsulphonates and the like.

Suitable polyester substrates are the polycondensates of dicarboxylic acids or derivatives thereof and difunctional alcohols, particularly glycols. Preferred polyester material is that produced by polycondensation of terephthalic acid with ethylene glycol. These materials can be used in any conventional processed form, e.g. yarn, woven and knitted goods. Blends of polyester with other fibres, e.g. cotton, may also be dyed according to the invention as far as the polyester part is concerned.

The mixtures of disperse dyes used for the process of the invention consist of a few individual disperse dyes each fulfilling the requirements (i) to (iv) indicated above. With these mixtures, reproducible dyeings having good fastness properties, particularly a good fastness to sublimation, are obtained. Furthermore, not only is the dyeing time at the higher temperature range significantly reduced but the dyeings are achieved with a high dyeing yield, thus rendering unnecessary the reductive afterclearing of the dyeings which is a necessary and difficult step in the hitherto known dyeing processes.

The known disperse dye mixtures which are used for rapid dyeing, i.e. in a shorter time, are far more complex and not all of the disperse dyes present fulfill the parameters (i) to (iv). These mixtures do not have all the advantages indicated above, particularly the high dyeing yield. As an example, in the known trichromic systems, each basic colour is obtained from a mixture of two or more disperse dyes having totally different chemical structures from one another. In comparison, a trichromic system according to the invention may consist of only three individual disperse dyes, one individual dye for each basic colour.

The following Examples, in which all parts and percentages are by weight and all temperatures in degrees Centigrade, illustrate the invention.

EXAMPLE 1

2,200 g of polyester texturized yarn in cheese form are dyed in a HT-circulating liquor dyeing machine (circulation speed: 4 rpm) in a liquor ratio of 1:7 with the following dyes:

0.78% C.I. Disperse Yellow 211

0.56% of the red dye of the formula I

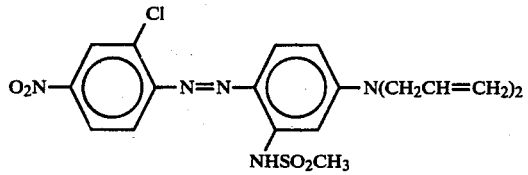

(I)

and 0.60% C.I. Disperse Blue 148

The dyes have the following properties:

| Dyes | A in % 120° C. 5' | 10' | 125° C. 5' | 10' | 130° C. 0 | 5' | 20' | D $\times 10^{-10}$ cm$^2$ sec$^{-1}$ | C.°/RTT | Z $\times 10^{-4}$ |
|---|---|---|---|---|---|---|---|---|---|---|
| D. Yellow 211 | 73 | 86 | 93 | 97 | 85 | 97 | 98 | 1.85 | 16.2 | 2.20 |
| I | 80 | 85 | 90 | 94 | 84 | 94 | 96 | 1.68 | 28.8 | 3.73 |
| D. Blue 148 | 79 | 88 | 90 | 93 | 81 | 93 | 96 | 1.96 | 23.5 | 3.29 |

The dyebath is heated from 70° C. with a heating rate of 3° C./minute. After dyeing for 10 minutes at 125° C. or 5 minutes at 130° C., the yarn is rinsed and dried. The exhaustion degree of the dyebath is >95%.

A brown dyed yarn is obtained with good fastnesses.

EXAMPLE 2

The procedure in Example 1 is repeated except that the yellow and/or blue dye is combined with the following red dye(s):

| Dyes | A in % 120° C. 5' | 10' | 125° C. 5' | 10' | 130° C. 0 | 5' | 20' | D $\times 10^{-10}$ cm$^2$ sec$^{-1}$ | C.°/RTT | Z $\times 10^{-4}$ |
|---|---|---|---|---|---|---|---|---|---|---|
| Disperse Red 73 | 82 | 90 | 90 | 96 | 91 | 96 | 97 | 1.88 | 21.2 | 2.89 |
| Disperse Red 106 | 64 | 72 | 80 | 88 | 71 | 91 | 95 | 2.41 | 14.9 | 2.37 |

What is claimed is:

1. A method of rapid dyeing a substrate comprising polyester fibers comprising bringing into contact with the substrate an aqueous dyebath at a temperature above 100° C. and containing a mixture of at least two disperse dyes, said mixture consisting of disperse dyes having each individually (i) a degree of absorption A≧90% after 5 minutes at 130° C. and ≧95% after 20 minutes of 130° C. for a standard dyeing depth of 4×1/1, the starting dyeing temperature being 70° C. and the heating rate 3° C./minute, (ii) a diffusion coefficient D at 130° C. $\geqq 1.6.10^{-10}$ cm$^2$.sec$^{-1}$, (iii) a ratio C.°/RTT≧14 wherein C.° is the saturation concentration in mg dye per g substrate and RTT is the dye concentration in mg per g substrate required for the standard dyeing depth 1/1, and (iv) a kinetic parameter $Z \geqq 1.6.10^{-4}$ wherein $Z = k.C.°/RTT\sqrt{D}$ wherein $k = 1$ cm$^{-1}$ sec$^{\frac{1}{2}}$.

2. A method according to claim 1, in which the degree of adsorption A is ≧70% after 10 minutes at 120° C., ≧80% after 5 minutes at 125° C., ≧90% after 5 minutes at 130° C. and ≧95% after 20 minutes at 130° C.

3. A method according to claim 1, in which the disperse dyes are used in amounts from 0.001 to 30% by weight based on the weight of the polyester substrate.

4. A method according to claim 1, in which a mixture of 2 or 3 individual dyes is used.

5. A method according to claim 1, in which the disperse dyes are selected from C.I. Disperse Yellow 211; C.I. Disperse Blue 148, C.I. Disperse Red 73, C.I. Disperse Red 105 and the dye of formula I

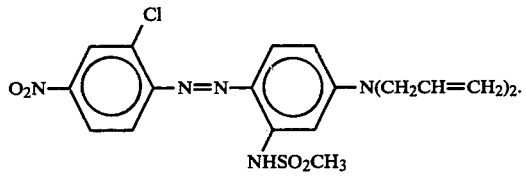

(I)

6. A method according to claim 1, in which the polyester substrate is dyed by exhaust.

7. A dyebath containing a mixture of at least 2 disperse dyes, said mixture consisting of disperse dyes having each (i) a degree of adsorption $A \geqq 90\%$ after 5 minutes at 130° C. and $\geqq 90\%$ after 20 minutes at 130° C. for a standard dyeing depth of $4 \times 1/1$, the starting dyeing temperature being 70° C. and the heating rate 3° C./minute, (ii) a diffusion coefficient D at 130° C. $\geqq 1.6.10^{-10}$ $cm^2.sec^{-1}$ (iii) a ratio $C.°/RTT \geqq 14$ wherein C.° is the saturation concentration in mg dye per g substrate and RTT is the dye concentration in mg per g substrate required for the standard dyeing depth 1/1, and (iv) a kinetic parameter $Z \geqq 1.6.10^{-4}$ wherein $Z = k.C.°/RTT\sqrt{D}$ wherein $k = 1\ cm^{-1}\ sec^{\frac{1}{2}}$.

8. A method according to claim 2 wherein, for each disperse dye, $D \geqq 1.8.10^{-10}\ cm^2.sec^{-1}$, $C.°/RTT \geqq 16$ and $Z \geqq 1.8.10^{-4}$.

9. A method according to claim 1 wherein the liquor to goods ratio is in the range 0.2:1 to 100:1.

10. A method according to claim 1 wherein the dyeing is effected at a temperature of 120° to 140° C.

11. A method according to claim 10 wherein the dyeing is effected at a temperature of 120° to 130° C. for 5 to 30 minutes.

12. A method according to claim 11 which further comprises rinsing and drying the material which has been dyed for 5 to 30 minutes.

13. A method according to claim 10 wherein there is no reductive afterclearing of the dyed substrate.

14. A method according to claim 9 wherein the liquor to goods ratio is in the range 1:1 to 15:1.

15. A method according to claim 6 wherein the dyeing is effected at a temperature of 120° to 140° C.

16. A method according to claim 15 wherein the dyeing is effected at a temperature of 120° to 130° C. for 5 to 30 minutes.

17. A method according to claim 16 wherein there is no reductive afterclearing of the dyed substrate.

18. A method according to claim 16 wherein the liquor to goods ratio is in the range 1:1 to 15:1.

19. A method according to claim 16 wherein, for each disperse dye,

A is $\geqq 70\%$ after 10 minutes at 120° C., 80% after 5 minutes at 125° C., $\geqq 90\%$ after 5 minutes at 130° C. and $\geqq 95\%$ after 20 minutes at 130%C., $D \geqq 1.8.10^{-10}\ cm^2.sec^{-1}$ $C.°/RTT \geqq 16$ and $Z \geqq 1.8.10^{-4}$.

20. A dyebath according to claim 7 wherein, for each disperse dye,

A is $\geqq 70\%$ after 10 minutes at 120° C., $\geqq 80\%$ after 5 minutes at 125° C., $\geqq 90\%$ after 5 minutes at 130° C., and $\geqq 95\%$ after 20 minutes at 130° C., $D \geqq 1.8.10^{-10}\ cm^2.sec^{-1}$ $C.°/RTT \geqq 16$ and $Z \geqq 1.8.10^{-4}$.

* * * * *